United States Patent [19]

Wharmby

[11] 4,069,994

[45] Jan. 24, 1978

[54] BAG HOLDER

[75] Inventor: Martin John Wharmby, London, England

[73] Assignee: English Glass Company Limited, Leicester, England

[21] Appl. No.: 639,593

[22] Filed: Dec. 10, 1975

[30] Foreign Application Priority Data

| | | |
|---|---|---|
| Sept. 9, 1975 | United Kingdom | 37141/75 |
| Jan. 21, 1975 | United Kingdom | 2514/75 |

[51] Int. Cl.[2] ..... B65B 67/12

[52] U.S. Cl. ..... 248/101; 248/99

[58] Field of Search ..... 248/95, 99, 101; 150/5, 150/6, 10

[56] References Cited

U.S. PATENT DOCUMENTS

| | | | |
|---|---|---|---|
| 2,040,271 | 5/1936 | Rosenzweig | 150/10 X |
| 2,074,843 | 3/1937 | Hiering | 150/10 X |
| 2,163,759 | 6/1939 | McCann | 248/95 X |
| 2,230,223 | 2/1941 | Hallock | 150/10 X |
| 3,329,382 | 7/1967 | Ryan | 248/99 |
| 3,614,041 | 10/1971 | Koger | 248/101 X |
| 3,627,243 | 12/1971 | Farrelli | 248/99 |
| 3,724,921 | 4/1973 | Lake | 248/99 X |
| 3,861,630 | 1/1975 | Ady | 248/101 X |
| 3,912,208 | 10/1975 | Grenetier | 248/99 |

FOREIGN PATENT DOCUMENTS

| | | | |
|---|---|---|---|
| 193,023 | 11/1964 | Sweden | 248/99 |
| 150,504 | 9/1920 | United Kingdom | 150/10 |

*Primary Examiner*—Marion Parsons, Jr.
*Assistant Examiner*—Rodney H. Bonck

[57] ABSTRACT

A bag holder of the type wherein a bag mouth is to be received and supported by a closed-figure frame of variable shape, the frame being made up of two elements, one being adapted to be attached at one side to a support and the other at an opposite side having handle means for the application of traction to the frame to bring it to a bag-opening configuration in which the elements are oppositely bowed so that their middle portions are spaced apart, the two elements lying face to face in a bag-closing configuration and being articulated together at their ends, and is characterized by the elements being biased to a bowed bag-closing configuration in which both are bowed in one direction. The biasing will be such that the element adapted to be attached to a support is concave (relative to the support) in the bag-closing configuration, traction on the handle means to bring the frame to the bag-opening configuration bring the said element through a straight to a convex configuration, the other element being concave (relative to the support) at all times.

17 Claims, 10 Drawing Figures

Figure 1:
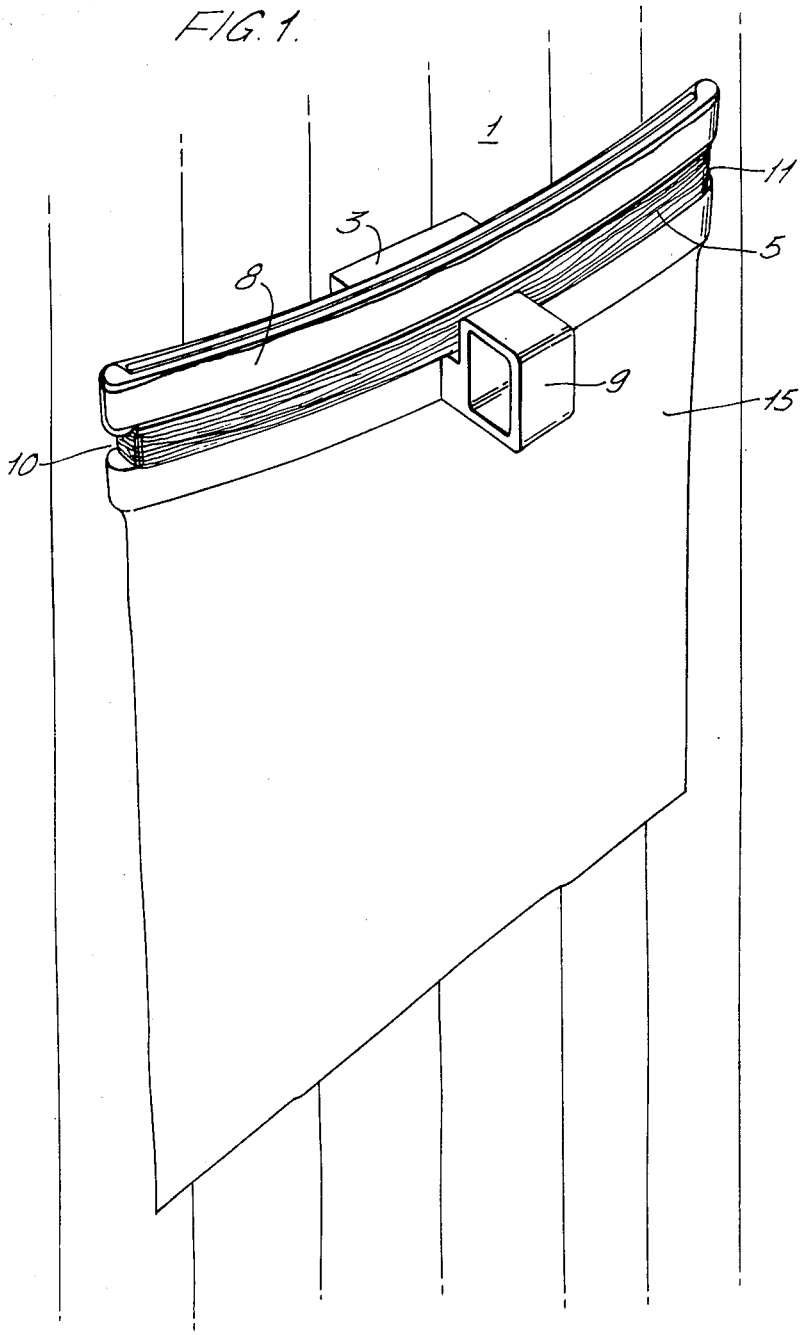

3
2
12
8
12
9
10
15

BAG HOLDER

FIELD OF THE INVENTION

This invention relates to bag holders, i.e. articles adapted to be mounted to a wall or be otherwise supported and to hold a bag by its mouth so that it hangs down and is ready to receive articles.

BACKGROUND OF THE INVENTION

A bag holder which can hold the mouth of a bag either in an open or a closed condition is clearly desirable, and various proposals have been made in, for example U.S. Pat. No. 3,374,976, DTAS No. 1,288,503, and most relevantly in Dutch Laid-Open specification No. 7,307,199 (Grenetier). In this last, a bag mouth is held by a frame made up of two spring elements hinged together at their ends to form a closed figure of variable shape. The spring elements are transversely curved spring steel strips so that they are biased to be straight and parallel to each other. At the middle of their lengths one is to be anchored to a wall or other support, the other has a pull handle. A bag depends from between the strips with it mouth turned out over them. If the handle is pulled the strips bend, the closed figure becomes rhomboidal and the mouth of the bag is held open. When the handle is released, the tendency of the spring steel strip is straighten, due to its transverse curvature, closes the mouth of the bag.

This arrangement uses a comparatively expensive material, transversely curved steel strip, to which the bag mouth conforms. Inherently, this material is biased towards a straight condition, and this may not be the most advantageous for efficient closing of a bag mouth. Also, separate entities must be provided to form the hinges at the ends of the strips, which is an economical and manufacturing disadvantage.

An articulated frame forming a closed figure of variable shape for holding the mouth of a bag has been proposed in U.S. Pat. No. 3,329,382 but this lacks any self-closing characteristic and could be complex to manufacture.

Transversely curved strips such as used by Grenetier had previously been disclosed, fixed together at their ends and for sewing into a hem surrounding a mouth of a pouch or wallet, in FRPS No. 1,209,370. This has the disadvantages mentioned above and, moreover, is a device of a type different from that of the present invention which is for temporary reception and holding of a bag relative to a support structure.

SUMMARY OF THE INVENTION

The present invention provides a bag holder of the type wherein a bag mouth is to be received and supported by a closed-figure frame of variable shape, the frame being made up of two elements, one being adapted to be attached at one side to a support and the other at an opposite side having handle means for the application of traction of the flame to bring it to a bag-opening configuration in which the elements are oppositely bowed so that their middle portions are spaced apart, the two elements lying face to face in a bag-closing configuration and being articulated together at their ends, and is characterised by the elements being biased to a bowed bag-closing configuration in which both are bowed in one direction. The biasing will be such that the element adapted to be attached to a support is concave (relative to the support) in the bag-closing configuration, traction on the handle means to bring the frame to the bag-opening configuration bring the said element through a straight to a convex configuration, the other element being concave (relative to the support) at all times.

The elements preferably are plastics material strips, rectangular in transverse section, and having integrally formed hinge elements at their ends to provide the articulation of the frame.

Biasing of the frame may be provided by the elements tending to return to a condition of repose in which they are bowed or may be provided, at least partly, by an elastic member passing from opposite end portions of the one element to behind a support block projecting from the one side of that element, i.e. from the face which is concave in the bag-closing configuration. This elastic member may be hooked onto the end portions of the one element, or may be a band passing completely round the frame from behind the said support block.

When bias is at least partly provided by an elastic member hooked to the one element, a further band may be provided to pass round the frame and act to retain a bag mouth on the frame.

A band which passes completely round the frame will preferably engage in registering notches at extreme ends of both of the elements whereby both to position the band and to hold the ends of the elements together in articulation.

Also, spaced-apart notches will preferably be provided in an edge of at least one of the elements which is an edge uppermost in use so that a band which passes completely round the frame may be reeved through the notches for more positive retention of a bag mouth.

It will be seen that simple, comparatively inexpensive elements and materials may be used to achieve a more effective bag closing position wherein the elements and therefore the bag mouth are bowed and constrained closely together. Because of this, the frame has to pass through an "overcentre" stage in which one element is changing from a concave to a convex bowing, or vice-versa. This gives a positiveness of action, particularly as the holder moves to a bag-closing condition. Hinge components may be integrally formed with the elements at their ends, for mutual interengagement to provide the articulation of the frame. The elements may be held together by a band passing round the frame which also has a biasing or a bag-holding effect. Threading such a band through spaced-apart notches in an upper edge of an element will assist in holding a bag mouth positively.

The holder of the present invention may be used for reception of refuse in houses, especially in kitchens and bathrooms, hospitals and caravans, for example, and will usually be secured to a wall, door or other vertical surface.

Figure 2:
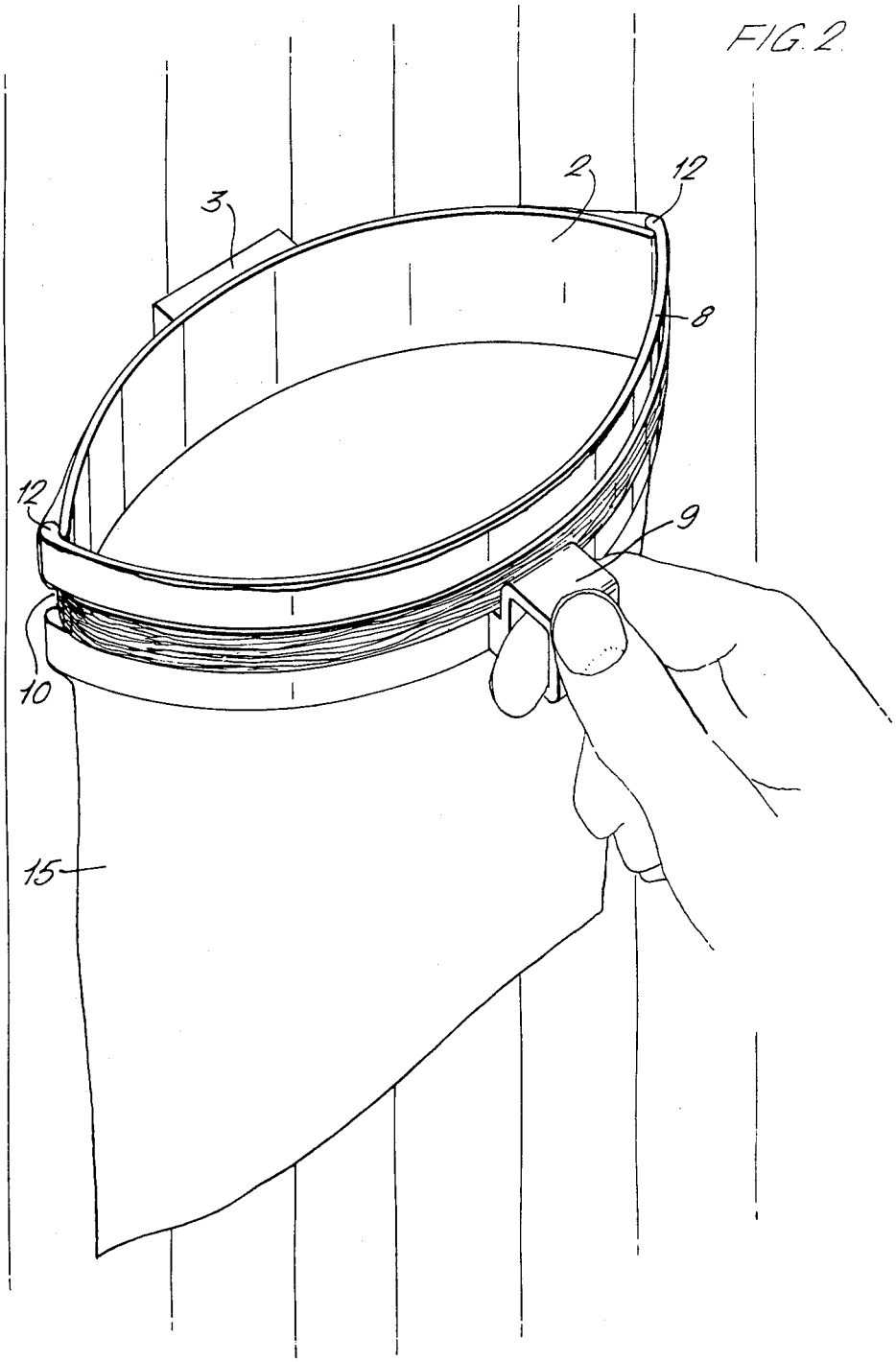
Figure 3:
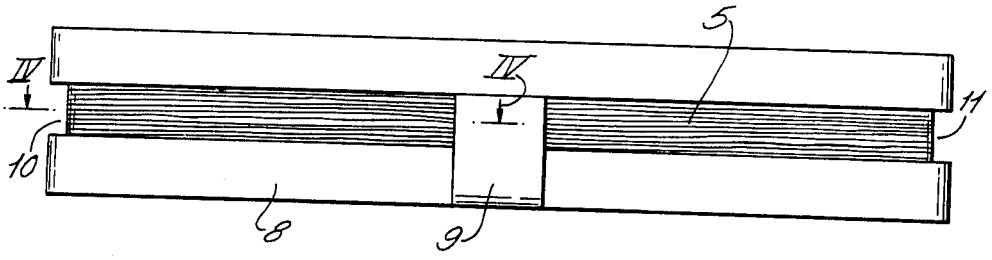
Figure 4:
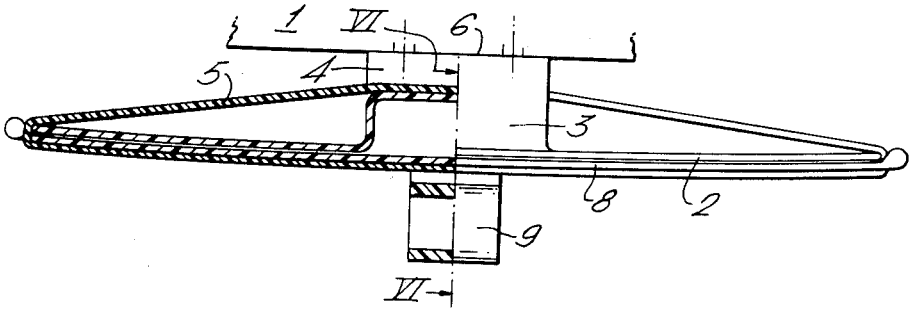
Figure 5:
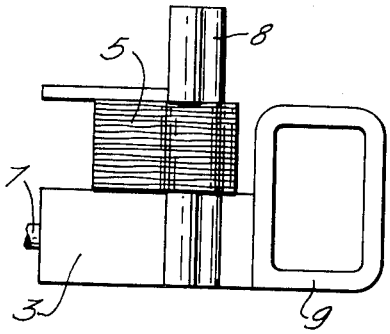
Figure 6:
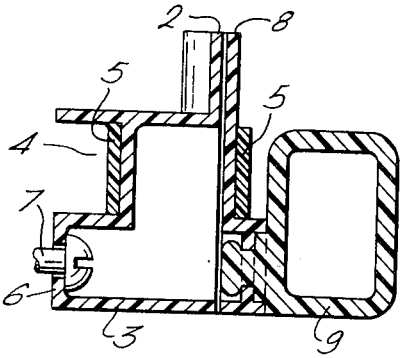
Figure 8:
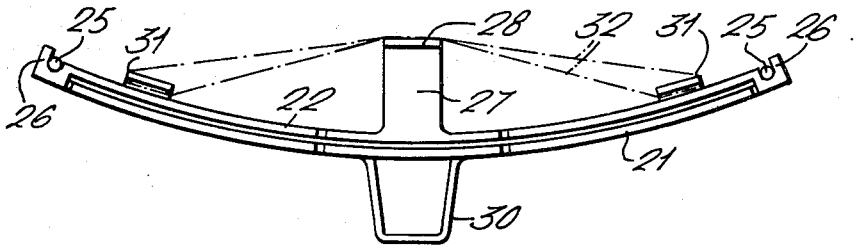
Figure 7:
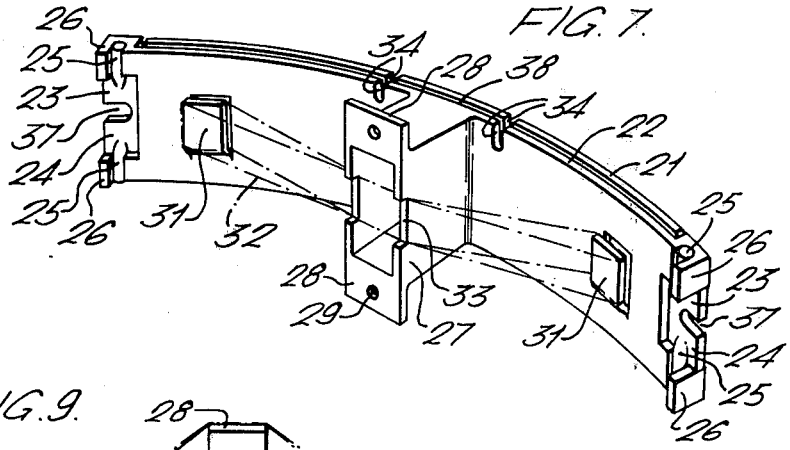
Figure 9:
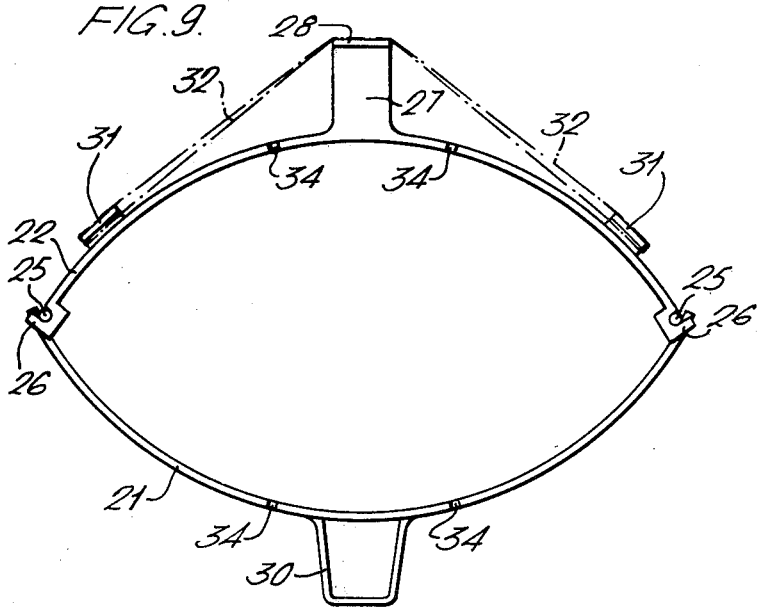
Figure 10:
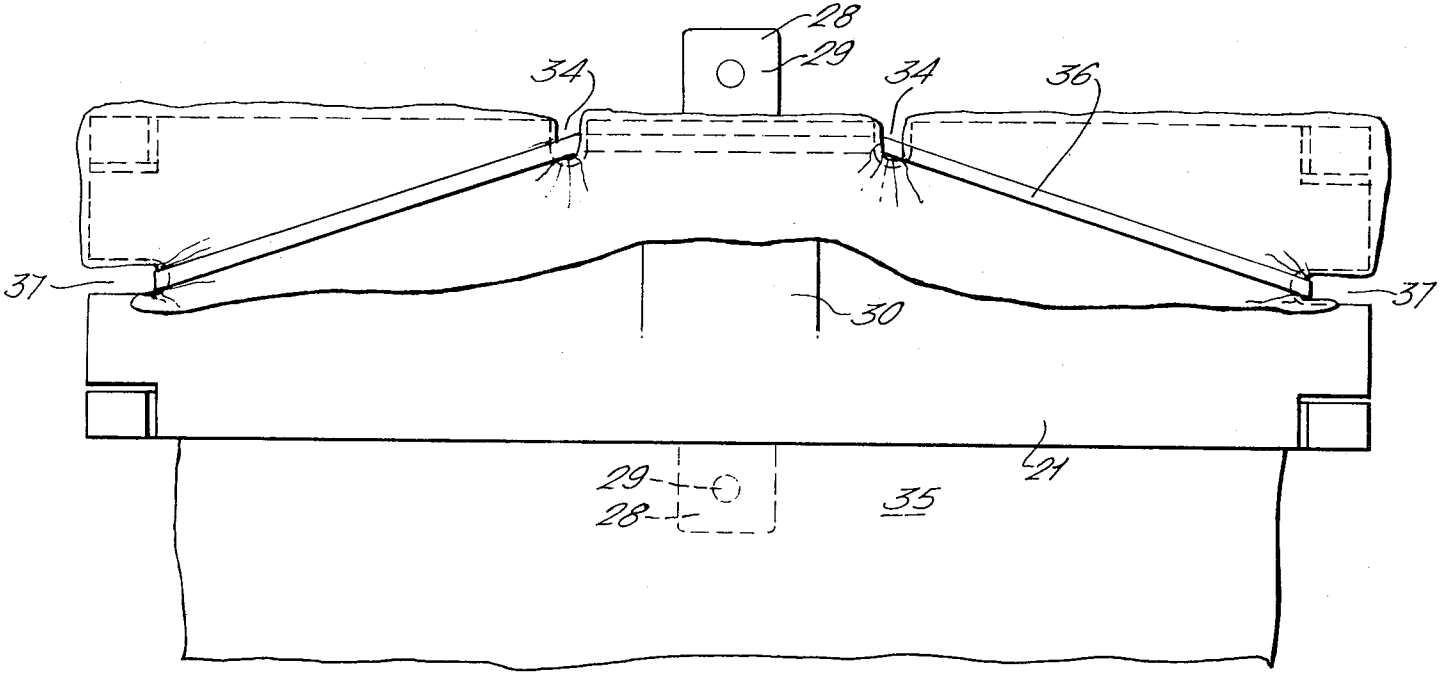

Particular embodiments of the invention will now be described with reference to the accompanying drawings wherein:

FIG. 1 is a perspective view of a first embodiment of the invention with a bag fitted and in its bag closing configuration, FIG. 2 is a perspective view of the first embodiment in its bag opening configuration, FIG. 3 is a front view of the first embodiment without the bag, FIG. 4 is a plan view, partly in section on the line IV—IV FIG. 3, FIG. 5 is an end view and FIG. 6 is a section on the line VI—VI of FIG. 4, FIG. 7 is a perspective view from behind of a second embodiment, FIG. 8 is a plan view of the second embodiment in bag closing configuration, FIG. 9 is a plan view of the second embodiment in bag opening configuration and FIG. 10 is a front face view of the second embodiment.

Both embodiments are bag holders and adapted to be secured at one side of a bag mouth holding frame for support such as the wall 1 shown in FIG. 1. An element 2 of a bag mount supporting frame has a plastics material strip which in vertical cross-section is rectangular. Midway between its ends it has integrally formed with it a hollow support block 3 through a rear wall of which runs a channel 4 for the reception of a rubber band 5 which will be more fully described later. The rear wall of the block 3 presents a flat face 6 through which screwholes allow the the securing of the block to the wall by means such as screw 7 (FIG. 6). A second element of the bag mouth holding frame is a plastics material element 8 also of rectangular vertical cross-section and having attached to its front surface a handle member 9. The elements are of the same length and have in each of their end portions registering notches 10, 11 through which also passes the band 5 which in this embodiment has two functions. Where it passes round the registering ends of the front and back elements 2,8 it holds them together in face-to-face contact and it also tends to bow the elements in the manner best seen in FIGS. 1 and 4 by virtue of the fact that it runs through the channel 4 in the support block 3 which is spaced behind the back surface of the rear element 2 therefore tending to cause that element to adopt a concave configuration when seen from the support surface 1. At each end of the front element 8 and vertically above and below the notches 10, 11 provided overhanging beads 12 which provide a bearing and articulation surface for the extreme ends of the rear element 2 especially when the frame is in its bag mouth opening condition (FIG. 2).

As can be best seen from FIG. 5 the handle 9 is spaced apart from the front element 8 so that the band 5 may pass between it and that element.

In use, this embodiment is disassembled by slipping the elastic band off from the front element 8 so that the hollow interior of the block 3 is exposed and the screws 7 or other securing members may be driven into the support surface. The front element 8 is then replaced in position and the band 5 slipped over it to engage in the notches 10,11. The bag to be secured and held by the holder, such as bag 15 (FIGS. 1 and 2) has its mouth brought up through the closed figure formed by the two elements thus held together and turned outwardly over the front and back elements and over the articulations at the end. If the bag and holder are of precisely related sizes the tension caused by this outwardly turning of the mount in all directions may be sufficient to hold the bag positively,. However, bags, particularly disposable ones, may not be manufactured to high tolerances and it may be desirable to at least partly lap the band 5 over an extreme edge portion of the mouth of the bag to assist in retention. Alternatively, means such as will be described with reference to the second embodiment may be employed, with spaced apart notches in a upper edge portion of at least front member, the band being reeved through them.

The second embodiment of bag holder, shown in FIGS. 7 to 10, is made like the first embodiment from a tough resilient thermo-plastics material. It comprises a pair of rectangular-section flexible elongate elements 21 and 22 each made by a single moulding operation. The two ends of the element 21 are each formed with a pair of substantially rectangular tabs 23 and 24, each tab carrying a short cylindrical pivot pin 25 extending transversely to the direction of elongation of the element 21 and ending substantially flush with the respective major edge of the plate 21. Each of the pivot pins 25 is engaged in a socket formed by a C-shaped channel 26 provided on the ends of the element 22. In the embodiment described element 21 is slightly longer than element 22 and a certain degree of force is required to clip the pivots 25 into the sockets 26. When the two elements are articulated in this manner the tension generated causes the two plates to bow slightly too, in the same direction. The rear face of the element 22 is provided with a support block 27 carrying two flanges 28 projecting upwardly and downwardly, each flange 28 having a hole 29 so that the element 22 can be screwed to a suitable vertical supporting surface, e.g. the door of a kitchen cupboard. It can be seen that screws can be driven through holes 29 without any disassembly of the bag holder. The front surface of element 21 is provided with a handle 30 as can best be seen in FIGS. 8 and 9, and the end portions of element 22 are also provided each with a bracket 31 arranged to receive the ends of a thick rubber band 32 so that when the band 32 is stretched between the brackets 31 and passes behind the support 27 it bends the elements into the bowed configuration shown in FIG. 8. The back of the support 27 is recessed at 33 to accommodate the band 32. Top edges of the elements 21 and 22 are slotted at 34 for reasons to be described later.

When in use the mouth of a disposable plastic bag 35 is inserted between the elements from below and then folded back over the upper edges of the elements 21 and 22 as can best be seen in FIG. 10. In order to ensure that the bag 35 is held in position a further rubber band 36 surrounds completely the frame formed by the elements. It is fitted over the bag material in recesses 37 in the tabs 23 and 24 and both on element 21 and on element 22 the rubber band 36 passes through to the innerface of the shallow lugs 38 created between the slots 34 so as to press the material of the bag laterally inwardly into recesses 37 and downwardly into slots 34 so as to hold the bag firmly when a load is placed in it. It will be appreciated that with the provision of this further band the size of bag, relative to the size of the holder, is not critical. If a bag of similar width to the bag holder is used then this can be held in place by folding its mouth outwardly over the elements and dispensing with the further band 36. It will be appreciated that when it is wished to put waste in the disposable bag all that is required is to pull the handle 30 against the natural resilience of the elements 21 and 22 and of the rubber band 32 into the position shown in FIG. 9. During the course of this, the element 22 goes from being concave (seen from the rear) to being convex, so that the frame goes through an "overcentre". On releasing the handle 30 the elements will return to the position shown in FIG. 8 in which they both are bowed in the same direction, this bowing positively sealing the bag.

The passing through the "overcentre" at the end of this movement, as the element 22 changes from being convex to concave (seen from the rear), gives a positiveness or snap to the final closing action.

Means for attachment to a support other than screws may be used; for example suction or adhesion pads.

Also, small upstanding lugs or ears may be provided to project upwardly from the upper edge of elements such as 21 or 22 or the second embodiment, at positions immediately adjacent the slots 34 and at the mutually more remote sides of those slots, to help in positioning and retaining a rubber band such as band 36.

I claim:

1. A bag holder comprising an articulatable frame for removably receiving around it an out-turned mouth of a bag, which frame is a closed figure constituted of two elongated flexible cooperable elements, each of said elements being substantially rectangular in cross section taken transversely to the length of said elements, means articulatingly connecting the elements to each other at their ends for enabling relative pivotal movement therebetween, means for attaching one of said elements to a support and handle means on the other of said elements by which traction may be exerted, both of said elements being pre-bowed in the same direction in a bag closing configuration, both being concave with respect to the support, both of said elements being movable through an overcenter snap position to a bag-opening configuration by traction on said handle means in which in the bag-opening configuration the elements at their middle portions are spaced apart and in which the element having said attaching means is given a reverse bow in opposite direction to be bowed convexly with respect to the support, the other element remaining bowed concavely with respect to the support, and means resiliently biasing the frame to the bag closing configuration.

2. A bag holder according to claim 1 wherein said means for biasing the frame to its bag-closing configuration comprises an elastic member having spaced portions bearing on spaced points located on said frame.

3. A bag holder according to claim 2 wherein the elastic member extends to the proximity of each end portion of said one element, the middle portion of said elastic member being spaced away from said one element having said means adapted for attachment to the support by the said means.

4. A bag holder according to claim 3 wherein the elastic member is a rubber band which passes completely round the frame.

5. A bag holder according to claim 3 wherein the elastic member is secured to and extends no further than each end portion of the element.

6. A bag holder according to claim 5 which additionally a includes rubber band which passes completely round the frame.

7. A bag holder according to claim 6 wherein inset notches are formed in the ends of said frame and the said rubber band passing completely round the frame being received in and positioned by said inset notches.

8. A bag holder according to claim 7 wherein the middle portion of at least the other element is provided at one edge uppermost in use with spaced-apart slots downwardly directed in use.

9. A bag holder according to claim 8 with the rubber band passing completely round the frame reeved through the slots to pass from an outwardly directed face of the element at each end portion of the element to an inwardly directed face at its middle portion.

10. A bag holder according to claim 1 wherein each said frame element is a plastics material strip of rectangular cross section.

11. A bag holder according to claim 10 wherein hinge means are integrally formed on each of the frame elements to thereby articulatingly connect said frame elements together, said hinge means including hinge pins on one of the frame elements and channels for receiving the hinge pins on the other of the frame elements.

12. A bag holder according to claim 11 wherein the length of said other of the elements between the hinge means is slightly greater than the length of said one frame element.

13. A bag holder according to claim 10 wherein the means adapted for attachment to a support are integrally formed with one element.

14. A bag holder according to claim 1 wherein both said elements are formed of material having at least partly an inherent tendency to adopt a position of repose in which they are both bowed.

15. A bag holder for releasably supporting a bag in a normally closed condition comprising a bag mouth holding frame including first and second elongated flexible elements pivotably connected at the corresponding ends thereof, attachment means carried by the first of said frame elements on a surface thereof remote from said second elemement for securing same to a support surface, handle means carried by the second of said frame elements on a surface thereof remote from said first element to apply a traction force on said frame; and means for biasing said first and second frame elements into a complementary arcuate bag-closing configuration in which both of said frame elements are bowed outwardly relative to the support surface, and movable in opposite directions upon the application of a traction force to said handle means to thereby separate the central portions of said frame elements and bring the frame into bag-opening configuration, said first frame element being given a reverse bow in moving from said bag-closing to said bag-opening configuration, and inset notches formed in the ends of said frame adapted to receive an elastic band which passes completely round the frame to hold said bag, said means for biasing said frame elements comprising an elastic member extending between and no further than each end portion of the first element and is at the middle portion of that element spaced away therefrom by the means adapted for attachment to the support.

16. A bag holder according to claim 15 wherein the middle portion of at least said second frame element is provided at one edge uppermost in use with spaced-apart slots downwardly directed in use to receive said elastic band.

17. A bag holder according to claim 16 wherein said elastic band passes completely round the frame and is received through the slots to pass from an outwardly directed face of the element at each end portion of the element to an inwardly directed face at its middle portion.

* * * * *